US007685836B2

(12) United States Patent
Yui

(10) Patent No.: US 7,685,836 B2
(45) Date of Patent: Mar. 30, 2010

(54) WATER COOLER WITH REFRIGERATOR OR WINE CELLAR

(76) Inventor: George Yui, 260 Scarlett Rd Apt 2013, Toranto, ON (CA) M6N 4X6

( * ) Notice: Subject to any disclaimer, the term of this patent is extended or adjusted under 35 U.S.C. 154(b) by 49 days.

(21) Appl. No.: 11/943,572

(22) Filed: Nov. 20, 2007

(65) Prior Publication Data

US 2008/0115525 A1 May 22, 2008

(51) Int. Cl.
*F25D 3/00* (2006.01)
*B67D 7/80* (2010.01)

(52) U.S. Cl. ..... 62/390; 62/389; 62/394; 62/399; 222/146.1; 222/185.1

(58) Field of Classification Search ..... 62/389, 62/390, 279, 394, 399; 165/61–66; 222/146.1, 222/146.6, 185.1
See application file for complete search history.

(56) References Cited

U.S. PATENT DOCUMENTS 5,619,856 A * 4/1997 Lee ..... 62/3.64
5,791,150 A * 8/1998 Bosher et al. ..... 62/62
7,287,392 B2 * 10/2007 Brand et al. ..... 62/132
2003/0097855 A1 * 5/2003 Rovira-Adame ..... 62/279
2004/0226313 A1 * 11/2004 Busick ..... 62/397

* cited by examiner

*Primary Examiner*—Frantz F Jules
*Assistant Examiner*—Cassey Bauer
(74) *Attorney, Agent, or Firm*—Michael Ries

(57) ABSTRACT

The present invention is a water cooler with refrigerator or wine cellar, having a water tank inside of the water cooler connected to a water bottle, a water tank lower part connected with a hot tank assembly and a cold tank assembly through a hot tank inlet tube and cold tank inlet tube. Cold tank and hot tank connect with two water taps through a cold tank outlet tube and a hot tank outlet tube, on the top of cold tank. There is an exhausting tube connecting with water tank, which connect with a compressor. On the back of the cooler a condenser is installed. The cold tank assembly is placed horizontally inside of a cold compartment at its highest point. The cold tank assembly includes a cold tank, evaporator coiled on the outside of cold tank the two parts are separated by separate pad.

11 Claims, 5 Drawing Sheets

WATER COOLER WITH REFRIGERATOR OR WINE CELLAR

This application claims the benefit of Chinese Patent Application No. 200620140000 filed Nov. 20, 2006.

TECHNICAL FIELD & BACKGROUND

The present invention generally relates to the field of water coolers more particularly a kind of water cooler with a refrigerator or wine cellar, mainly used for home or office areas.

With today's health conscious lifestyle and the need to conserve as much space as possible having both a water cooler and refrigerator are desired for people's daily life. However, if people buy both a refrigerator and a water cooler not only is the cost high, also both occupy a lot of space. So the products with different kinds of both refrigerators and water coolers appeared in the market. Most common designs have one compressor cooling the water tank and cold compartment all at the same time. Others have an evaporator linked with a condenser inline. This system has a problem in distribution of cold energy. When water is used and cold compartment is not, the cold tank is prompting refrigeration system to work and cool water, while refrigerator is getting cooled more then required.

If the refrigerator is used more then the water, the water may become too cold refrigerator compartment is used excessively then the water in the cold tank will freeze, and it could not be defrosted quickly.

So, some designs have two evaporators and two capillaries with one compressor cooling both in a priority sequence one at the time using a Y-Type solenoid valve. But this type of cooler's cost is too high, and is difficult to make it smaller and its not good for volume production.

The technology problems solved by the present invention are to provide a type of water cooler or refrigeration system with a refrigerator or wine cellar, to make the structure design reasonable, and distribute the cooling reasonably, use cooling fully and preventing the cold tank from becoming frozen. The set up for the temperature of the cold tank and cold compartment should be reasonable, to allow cold water to flow out and also guarantee a suitable temperature for the cold compartment.

The technology design adopted by the present invention is a water cooler with a refrigerator or wine cellar, having a water tank inside of the water cooler connected to a water bottle, the water tank lower part connects with a hot tank assembly and cold tank assembly through a hot tank inlet tube and a cold tank inlet tube. The cold tank and hot tank are connected with two water taps through the cold tank outlet tube and the hot tank outlet tube. On the back of the cooler a condenser is installed. The stated cold tank assembly is placed horizontally inside of the cold compartment at its highest point. The stated cold tank assembly includes the cold tank, the evaporator coiled on the outside of cold tank and contained within own tube. Evaporator and cold tank are separated by an air gap whose precise dimensions are controlled by spacers. A tube around the evaporator acts as an enclosure. A fan for circulating air is installed at one end of the tube.

Cold tank inlet tube and cold tank outlet tube installed on the center of the cold tank. The stated cold tank hot water inlet tube connects with hot tank outlet tube by a solenoid valve. Inside of the stated cold tank and cold compartment, the cold tank thermostat and cold compartment thermostat are installed separately. The stated hot tank and compressor are installed under the cold compartment. There is a condensate evaporator above the compressor and under the condensate outlet of the stated cold compartment. The stated hot tank and compressor are installed above the cold compartment. The stated cold compartment condensate outlet has installed an evaporator with a heater plate.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Figure 1:
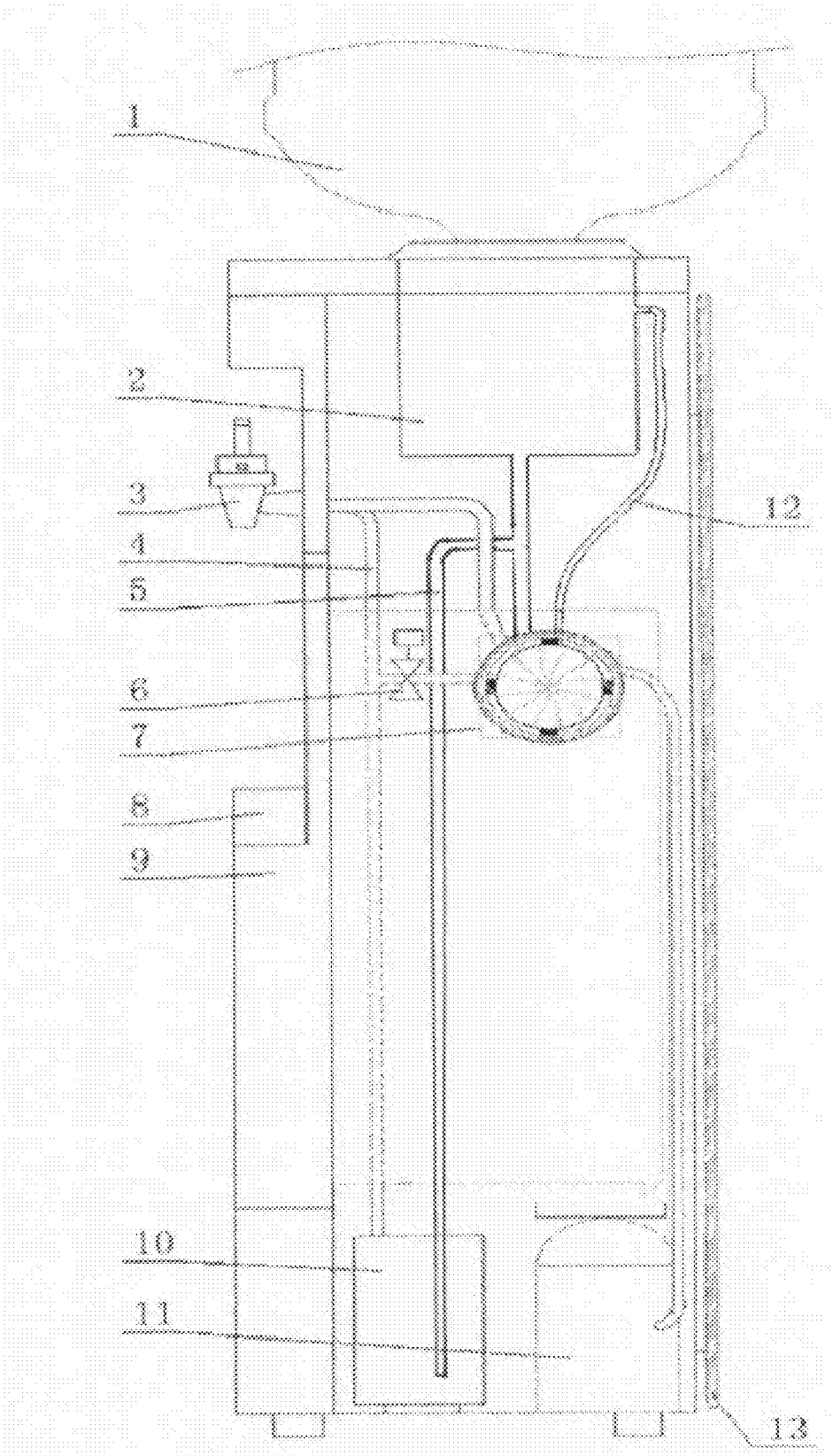
FIG. 1 illustrates a side view of a water cooler with refrigerator or wine cellar, in accordance with one embodiment of the present invention.
Figure 2:
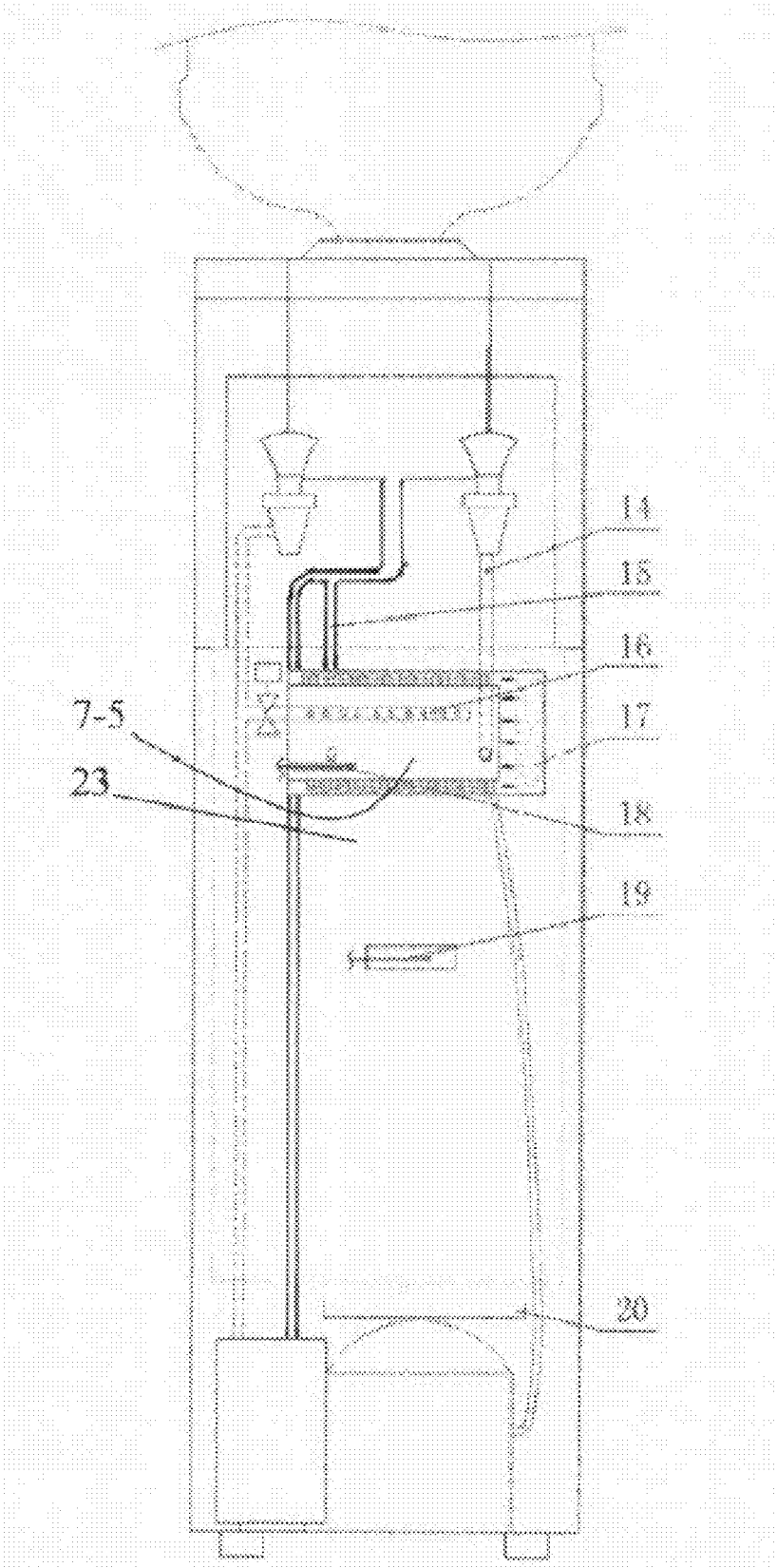
FIG. 2 illustrates a front view of a water cooler with refrigerator or wine cellar, in accordance with one embodiment of the present invention.

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention; however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Now referring to FIGS. 1-5, as in one embodiment of the present invention, a water tank 2 is inside of a water cooler connected with a water bottle 1, water tank lower part connect with hot tank assembly 10 and cold tank assembly 7 through hot tank inlet tube 5 and cold tank inlet tube 15. A cold tank 7-5 and hot tank 10 are connected with two water taps 3 through cold tank outlet tube 14 and hot tank outlet tube 4, on the top of cold tank 7-5, there is an exhausting tube 12 connecting with water tank 2, to eliminate air locks and allow water to fill the cold water tank.

The cold tank assembly 7 connects with compressor 11. There are two ways of installing compressors, in one example, hot tank 10 and compressor 11 are installed under the cold compartment 23, in this structure, under the condensate outlet of cold compartment 23 and above compressor 11, there is condensate evaporator 20, this way compressor's heat can evaporate the condensate. On the back of the cooler, condenser 13 is installed.

In the present invention as in one embodiment, the cold tank assembly 7 is placed horizontally inside of the cold compartment 23 at its highest point. The cold tank assembly 7 includes cold tank 7-5, evaporator 7-3 coiled on the outside of cold tank, two parts are separated by separate pad 7-4. So there is a gap between cold tank and evaporator; the stated evaporator 7-3, there is a tube shaped cold tank 7-2 cover made from metal, and there is a fan 17 installed on the end of the inside of the cover, which will help the air move between the cold tank and evaporator. Air flow distributes cold from the evaporator evenly and cools water tank and refrigerated compartment simultaneously. If water tank becomes too cold, air flow helps to remove excessive cold and distribute inside of refrigerated compartment.

This was having cold water tank inside of refrigerated compartment makes it into one unit and reduces significantly or eliminates problems associated with un-even cold distribution. This cooling system is called Turbochill due to its use of turbine design in placing fan inside of the tunnel.

in one example, cold tank inlet tube 15 and cold tank outlet tube 14 installed on the center of cold tank 7-5, which can prevent freezing.

To avoid cold tank freezing the cold tank has a cold tank hot water inlet tube 16, which is controlled by solenoid valve 6 and connects with hot tank outlet tube 4. To avoid the cold tank from potential freezing, in the cold tank 7-5 there is a cold tank thermostat sensor 18, once the water temperature in the cold tank is too low, the sensor will activate solenoid valve 6 to open, then the hot water will enter the cold tank and melt the ice.

The same feature can be used to sterilize cold water tank with hot water. This is done by microprocessor that opens and closes connecting solenoid valve at preset time intervals.

To maintain cold compartment function, the cold tank thermostat sensor 18 will check the temperature in the cold tank 7-5, if it is over a pre set temperature, then it will control the compressor 11 to do the cooling work, to lower the temperature in the cold tank 7-5 at the same time, the evaporator tube 7-3 and fan 17 are work together, to transfer the cold tank 7-5 lower temperature to cold compartment 23, The thermostat sensor of cold compartment 19 will check the temperature in the cold compartment when the temperature in the cold tank 7-5 reaches the pre set temperature, the compressor 11 stops working. At this time, if the temperature in the cold compartment 23 does not reach the pre set temperature, then fan 17 keeps on working, make the temperature in the cold tank and cold compartment very close. If after the two above steps, the temperature in the cold tank 7-5 goes up again, then compressor 11 works again, to cool the water in the cold tank 7-5, and repeat the above steps, until the temperature in the cold compartment 23 reaches the pre set temperature. The condensate in the cold compartment 23 flows into condensate evaporator 20 through cold compartment outlet 25, at the same time using the heat made by compressor 11 to be vaporized.

Figure 3:
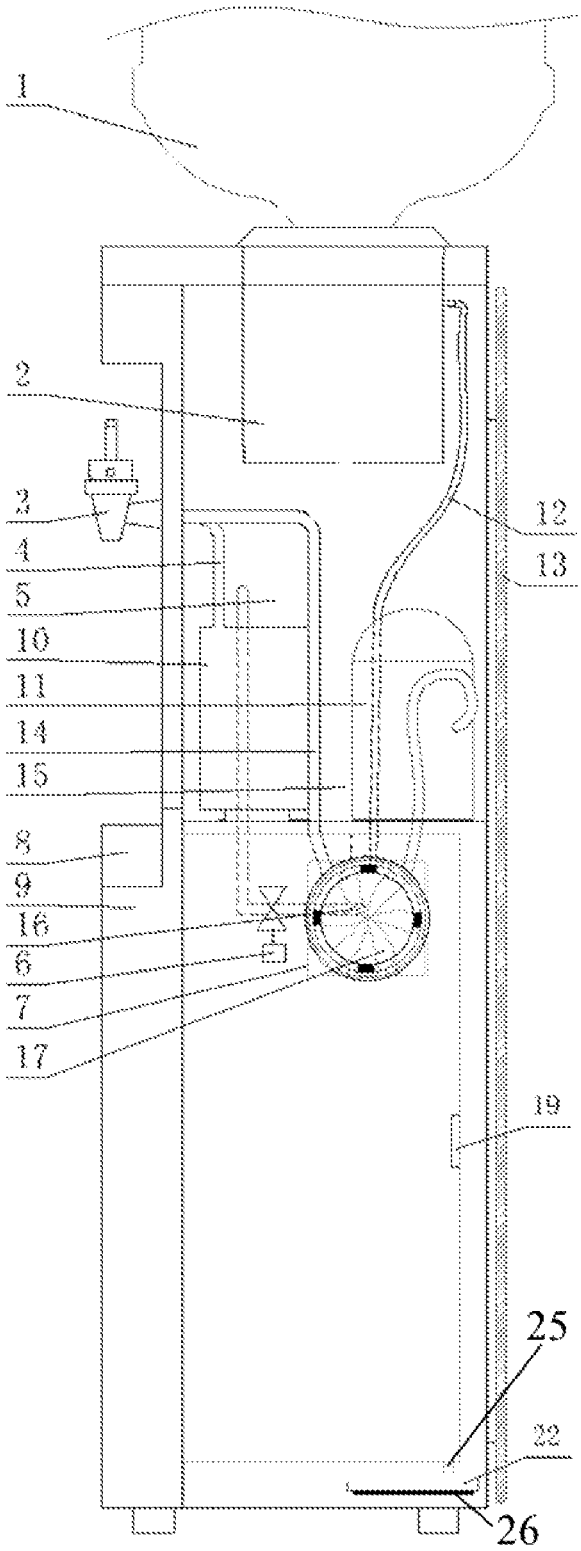
FIG. 3 illustrates a side view of a water cooler with refrigerator or wine cellar, in accordance with one embodiment of the present invention.
Figure 4:
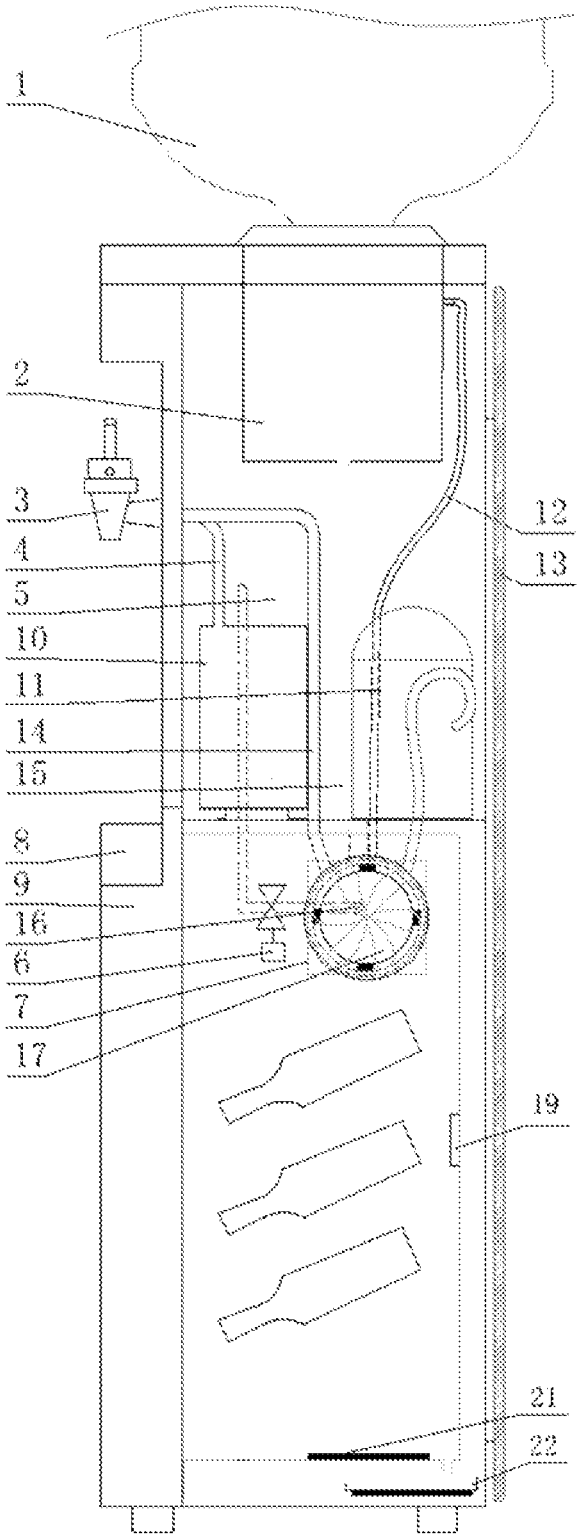
FIG. 4 illustrates a side view of a water cooler with refrigerator or wine cellar, in accordance with one embodiment of the present invention.
Figure 5:
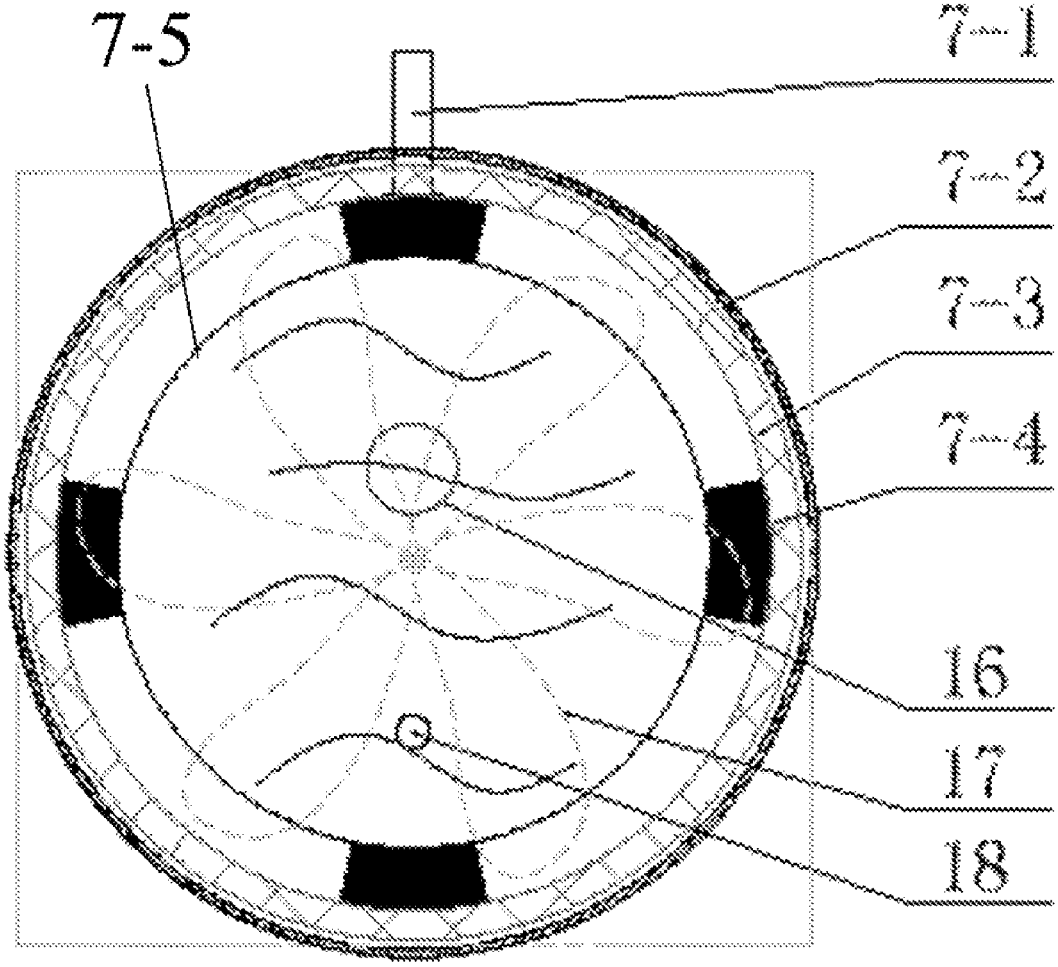
FIG. 5 illustrates a side view of a cold tank assembly, in accordance with one embodiment of the present invention.

Referring to FIG. 3, as in one embodiment, the hot tank 10 and compressor 11 are installed above the cold compartment 23 and has a heater plate 26 or Positive Temperature Coefficient heating elements (PTC) that can heat and control itself from overheating and installed with the evaporator 22 under the outlet of condensate 25, to vaporize the water. Under the cold compartment 23, there is a heater plate 21 the cold compartment 23 is mainly for wine cellar, for storing wine. The thermostat sensor 19 of cold compartment is to check the temperature inside. The heater plate 21 installed can heat the compartment to avoid too low of a temperature ensuring the wine quality.

While the present invention has been related in terms of the foregoing embodiments, those skilled in the art will recognize that the invention is not limited to the embodiments depicted. The present invention can be practiced with modification and alteration within the spirit and scope of the appended claims. Thus, the description is to be regarded as illustrative instead of restrictive on the present invention.

What is claimed is:

1. A water cooler comprising:

a water cooler housing defining an enclosed cold compartment;

a water tank positioned within the water cooler housing and selectively in fluid connection with a water bottle;

a hot tank, wherein the hot tank is not positioned within the cold compartment;

a cold tank having a horizontal axis wherein the cold tank is positioned within the cold compartment;

a first tube having a first end in fluid communication with the water tank, a second end in fluid communication with the cold tank, and an intermediate portion interposed between the first end and the second end;

a second tube having a second tube inlet directly connected to the intermediate portion of the first tube and a second tube outlet in fluid communication with the hot tank, wherein the second tube inlet is positioned above the cold tank;

a cold water tap connected to an outlet of the cold tank;

a hot water tap connected to an outlet of the hot tank;

a compressor;

a condenser coupled to the water cooler housing, wherein the condenser is not positioned within the cold compartment; and an evaporator coiled about the horizontal axis of the cold tank, wherein the compressor, evaporator and the condenser selectively operate to reduce the temperature of the cold tank.

2. The water cooler of claim 1, further comprising a solenoid valve operatively positioned between the outlet of the hot tank and the cold tank.

3. The water cooler of claim 1, further comprising a cold tank sensor for detecting the temperature of a fluid within the cold tank, and a cold compartment thermostat for detecting the temperature of a fluid within the cold compartment.

4. The water cooler of claim 1, wherein both the hot tank and the compressor are positioned below the cold compartment.

5. The water cooler of claim 1, further comprising a condensate outlet formed in the cold compartment and a condensate evaporator positioned between the condensate outlet and the compressor.

6. The water cooler of claim 1, wherein both the hot tank and the compressor are positioned above the cold compartment.

7. The water cooler of claim 1, further comprising a condensate outlet formed in the cold compartment and a condensate evaporator having a heating plate, wherein a condensate will exit the cold compartment through the condensate outlet in liquid form and the condensate will be then evaporated by heat provided by the heating plate.

8. The water cooler of claim 1, further comprising a heating plate positioned below the cold compartment, wherein a condensate will exit the cold compartment in liquid form and the condensate will be then evaporated by heat provided by the heating plate.

9. The water cooler of claim 1, wherein a heating plate is heated by a Positive Temperature Coefficient (PTC) heating element.

10. The water cooler of claim 1, further comprising a fan operatively positioned to circulate air from a first portion of the cold compartment through a second portion of the cold compartment and then to the first portion of the cold compartment, wherein the cold tank is positioned within the second portion of the cold compartment, the cold tank is not positioned within the first portion of the cold compartment, the circulation of air will reduce the temperature of the first portion of the cold compartment, and the cold tank is positioned at the highest point of the cold compartment.

11. The water cooler of claim 1, further comprising a heating portion for increasing the temperature within the cold compartment.

* * * * *